US010840659B2

(12) United States Patent
Fukatsu et al.

(10) Patent No.: US 10,840,659 B2
(45) Date of Patent: Nov. 17, 2020

(54) JOINT CONNECTOR AND BUSBAR

(71) Applicant: Sumitomo Wiring Systems, Ltd., Mie (JP)

(72) Inventors: Yukihiro Fukatsu, Mie (JP); Toshikazu Sakurai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/738,215

(22) Filed: Jan. 9, 2020

(65) Prior Publication Data

US 2020/0251866 A1 Aug. 6, 2020

(30) Foreign Application Priority Data

Jan. 31, 2019 (JP) ..... 2019-015410

(51) Int. Cl.
*H01R 31/08* (2006.01)
*H01R 43/16* (2006.01)
*H01R 13/428* (2006.01)

(52) U.S. Cl.
CPC ..... *H01R 31/085* (2013.01); *H01R 13/428* (2013.01); *H01R 43/16* (2013.01)

(58) Field of Classification Search
CPC .... H01R 31/085; H01R 13/428; H01R 13/16; H01R 13/4323; H01R 13/4326; H01R 13/432; H01R 25/00; H01R 25/162
USPC ..... 439/251; 29/893.33
See application file for complete search history.

(56) References Cited

U.S. PATENT DOCUMENTS 3,048,812 A * 8/1962 Heidler ..... H01R 13/055 439/825
3,324,447 A * 6/1967 Pistey ..... H01R 4/4827 439/441
4,553,799 A * 11/1985 Deters ..... H01R 31/085 439/507
5,000,699 A * 3/1991 Nadin ..... H01R 31/08 439/189
5,261,840 A * 11/1993 Benz ..... H01R 4/4881 439/843
5,556,301 A * 9/1996 Chishima ..... H01R 13/53 439/101

(Continued)

FOREIGN PATENT DOCUMENTS

JP 10-255935 9/1998

*Primary Examiner* — Harshad C Patel
(74) *Attorney, Agent, or Firm* — Gerald E. Hespos; Michael J. Porco; Matthew T. Hespos

(57) ABSTRACT

A housing (10) has a mounting groove (12) between a first cavity (11A) in a first stage and second cavities (11B) in a second stage. A first communication portion (13A) allows communication between the mounting groove (12) and the first cavity (11A), Second communication portions (13B) allow communication between the mounting groove (12) and the second cavities (11B). A first terminal (20A) is accommodated in the first cavity (11A), and second terminals (20B) are accommodated in the second cavities (11B). A busbar (60) includes a plate-shaped body (61) accommodated in the mounting groove (12). A first contact piece (62A) integrally projects from the busbar body (61) toward the first stage and enters the communication portion (13A) to contact the first terminal (20A), and second contact pieces (62B) integrally project from the busbar body (61) toward the second stage and enter the communication portions (13B) and contact the second terminals (20B).

6 Claims, 3 Drawing Sheets

(56) References Cited

U.S. PATENT DOCUMENTS

| | | | | |
|---|---|---|---|---|
| 5,588,884 | A * | 12/1996 | Rudoy | H01R 13/187 439/787 |
| 5,662,487 | A * | 9/1997 | Okamura | H01R 31/08 29/876 |
| 7,320,623 | B2 * | 1/2008 | Hisamatsu | H01R 13/6485 439/108 |
| 7,497,733 | B1 * | 3/2009 | Van der Steen | H01R 23/6873 439/607.01 |
| 7,503,798 | B2 * | 3/2009 | Hashim | H01R 4/2433 439/405 |
| 8,062,071 | B2 * | 11/2011 | Yamakami | H01R 13/514 439/631 |
| 8,167,631 | B2 * | 5/2012 | Ito | H01R 24/38 439/108 |
| 8,579,650 | B2 * | 11/2013 | Keswani | H01R 4/4818 439/441 |
| 8,864,524 | B2 * | 10/2014 | Sato | H01R 13/245 439/630 |
| 9,142,901 | B2 * | 9/2015 | Ando | H01R 13/11 |
| 9,300,070 | B2 * | 3/2016 | Yoshikawa | H01R 12/714 |
| 9,548,554 | B2 * | 1/2017 | Yoshikawa | H01R 4/023 |
| 10,224,658 | B2 * | 3/2019 | Marsh | H01R 13/426 |
| 2002/0031941 | A1 * | 3/2002 | Cote | H01R 25/162 439/511 |
| 2009/0181559 | A1 * | 7/2009 | Malstrom | H01R 31/085 439/66 |
| 2014/0158395 | A1 * | 6/2014 | Billman | H02B 7/00 174/68.2 |
| 2017/0250504 | A1 * | 8/2017 | Bang | H01R 13/631 |

* cited by examiner

JOINT CONNECTOR AND BUSBAR

BACKGROUND

Field of the Invention

The invention relates to a joint connector and a busbar.

Related Art

Japanese Unexamined Patent Publication No. H10-255935 discloses a joint connector with a connector housing having terminal accommodation chambers and a plate accommodating portion. Terminal fittings are accommodated in the respective terminal accommodation chambers and a busbar is accommodated in the plate accommodating portion for connecting the respective terminal fittings in a short-circuit state. The terminal accommodation chambers are provided side by side in the connector housing and are at the same interval in a column direction in upper and lower stages. The plate accommodating portion is provided between the upper and lower terminal accommodation chambers and includes a communication part communicating with the respective terminal accommodation chambers. The busbar has a double-plate structure formed by folding a metal plate. The busbar includes a coupling piece, which is a folding base end part. Resilient contact pieces project obliquely to an upper-rear end and a lower rear end from the coupling piece and are provided side by side at the same interval in the column direction. Each resilient contact piece resiliently contacts a tongue of the corresponding terminal fitting through the communication part with the busbar accommodated in the plate accommodating portion.

In the above case, the upper and lower resilient contact pieces are arranged at the same positions in the column direction. Thus, the busbar had to have the double-plate structure. However, if the busbar has the double-plate structure, a material yield is poor, thereby causing a problem of high manufacturing cost.

The invention was completed on the basis of the above situation and provides a joint connector and a busbar with improved a material yield and reduced manufacturing cost.

SUMMARY

The invention is directed to a joint connector with a housing including at least one first cavity provided in a first stage, a row of second cavities provided in a second stage and a mounting groove between the first and second stages. At least one first terminal is to be accommodated in the first cavity, second terminals are to be accommodated in the second cavities, and a busbar made of metal is to be mounted into the mounting groove. The first cavity and the second cavities are arranged alternately in a column direction while being shifted in the housing. The busbar includes a busbar body in the form of a single plate. At least one first contact piece and plural second contact pieces project from the busbar body. The at least one first contact piece projects toward the first stage side and is configured to contact the first terminal. The second contact pieces project from the busbar body toward the second stage side and are configured to contact the second terminals.

The invention also is directed to a busbar with a busbar body in the form of a single plate. At least one first contact piece is cut in the busbar body by being and raised toward a first side in a plate thickness direction of the busbar body. The at least one first contact piece contacts a first terminal on the first side in the plate thickness direction. Plural second contact pieces are cut in the busbar body and raised toward a second side in the plate thickness direction of the busbar body. The second contact pieces contact second terminals on a second side in the plate thickness direction. The first and second contact pieces being are arranged alternately in a column direction.

The first and second contact pieces are arranged alternately in the column direction and project toward sides opposite to each other. Thus, these contact pieces can be formed from the busbar body in the form of a single plate. The first and second cavities are arranged alternately in the column direction while being shifted. Accordingly, intervals of the first and second terminals accommodated in the first and second cavities are shifted in the column direction and, consequently, intervals of the first and second contact pieces to be held respectively in contact with the first and second terminals are shifted in the column direction. Therefore, the busbar body can be a single-plate with a correspondingly improved material yield in forming the busbar and reduced manufacturing cost.

The housing may include a first communication portion allowing communication between the mounting groove and the first cavity in the row direction and second communication portions allowing communication between the mounting groove and the second cavities in the row direction. Surfaces of the mounting groove facing the first and second communication portions may define restricting surfaces that are configured to restrict excessive deflection of the first and second contact pieces. According to this configuration, the restricting surfaces restrict excessive deflection of the first and second contact pieces. These restricting surfaces are surfaces of the mounting groove facing the first and second communication portions and need not have a special shape. Thus, the structure is not complicated.

The first contact piece is cut and raised toward the first stage, and the second contact pieces are cut and raised toward the second stage in the busbar body. A frame is provided outside the first and second contact pieces and extends over an entire periphery. According to this configuration, the first and second contact pieces can be formed easily from the busbar body. Further, the first and second contact pieces are provided by cutting and raising, and it is difficult to ensure strength. However, the busbar body is a single plate, and the frame extends over the entire periphery outside the first and second contact pieces. Therefore, the strength of the busbar body can be ensured.

Each of the first and second terminals may include a tubular body, and the first and second contact pieces may contact outer surfaces of the bodies. According to this configuration, general-purpose female and male terminal fittings can be used as the first and second terminals. Therefore, connection to mating terminals via the bodies different from that via the busbar is possible and a width of a joint circuit can be expanded.

DETAILED DESCRIPTION

Figure 1:
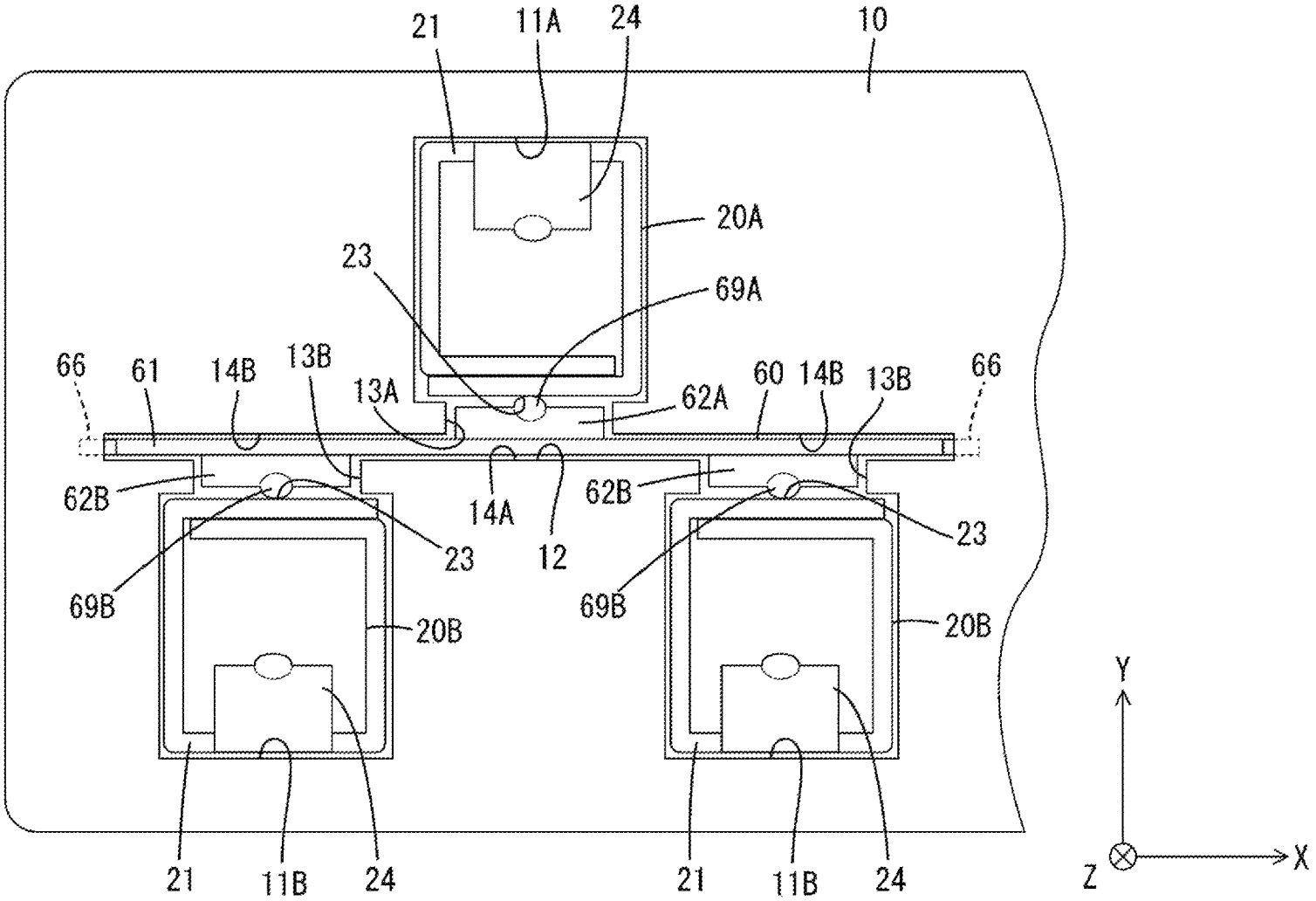
FIG. 1 is a structural diagram of a joint connector viewed from front in an embodiment of the present invention.

One embodiment of the invention is described with reference to FIGS. 1 to 3. As shown in FIG. 1, a joint connector of this embodiment includes a housing 10, a first terminal 20A and second terminals 20B accommodated in the housing 10 and a busbar 60 likewise accommodated in the housing 10 for short-circuiting the first terminal 20A and the second terminals 20B. The housing 10 is fittable to an unillustrated mating housing. Unillustrated mating first terminal and mating second terminals are accommodated in this mating housing. When the housing 10 is fit to the mating housing, the first terminal 20A is connected to the mating first terminal, the second terminals 20B are connected to the mating second terminals and these terminals are joined via the busbar 60. The busbar 60 is accommodated into the housing 10 accommodating the first terminal 20A and the second terminals 20B instead of in a dedicated relay housing. Thus, the configuration is simplified.

[Housing 10]

The housing 10 is made of synthetic resin, and is in the form of a block that can fit to the mating housing from the front. As shown in FIG. 1, the housing 10 includes a first cavity 11A and second cavities 11B penetrating in a front-rear direction (axial direction, Z direction of FIG. 1). The first cavity 11A is an opening having a rectangular cross-section and is arranged in an upper stage of the housing 10. The second cavities 11B are openings having the same rectangular cross-section as the first cavity 11A, and two second cavities 11B are arranged in a lower stage of the housing 10. The first cavity 11A and the second cavities 11B are arranged alternately while being shifted by one cavity in a width direction (column direction, X direction of FIG. 1), which is an arrangement direction of the respective second cavities 11B. That is, the first cavity 11A and the respective second cavities 11B are offset in a zigzag manner in the width direction so that the second cavities 11B are arranged at both widthwise sides of the first cavity 11A. Note that, even if there are two or more first cavities 11A and there are three or more second cavities 11B, the first cavities 11A and the second cavities 11B are disposed to satisfy the above relationship of being arranged alternately in the width direction while being shifted by one cavity.

The housing 10 includes a mounting groove 12 in the form of a slit elongated in the width direction between the first cavity 11A and the second cavities 11B in a height direction (row direction, Y direction of FIG. 1). The mounting groove 12 is open in the front surface of the housing 10 and is at a center position in the height direction between the first cavity 11A and the second cavities 11B. The mounting groove 12 has a width exceeding a distance between opposite widthwise ends of the second cavities 11B and a vertical clearance slightly exceeds a plate thickness of a later-described busbar body 61 of the busbar 60.

The housing 10 includes one first communication portion 13A allowing communication between the mounting groove 12 and the first cavity 11A in the height direction and two second communication portions 13B allowing communication between the mounting groove 12 and the respective second cavities 11B in the height direction. The first and second communication portions 13A and 13B are open in the front surface of the housing 10. The second communication portions 13B are at both widthwise sides of the first communication portion 13A. The first and second communication portions 13A and 13B are narrower than the first and second cavities 11A and 11B and slightly larger than a width of each of later-described first and second contact pieces 62A and 62B of the busbar 60.

The upper and lower surfaces of the mounting groove 12 are horizontal flat surfaces along the width direction and include restricting surfaces 14A, 14B for restricting excessive deformation of the later-described first and second contact pieces 62A and 62B of the busbar 60 in a lower surface area facing the first communication portion 13A from below and upper surface areas facing the respective second communication portions 13B from above.

[First Terminal 20A and Second Terminals 20B]

One first terminal 20A is inserted into the first cavity 11A from behind and accommodated in the housing 10, and two second terminals 20B are inserted into the respective second cavities 11B from behind and accommodated into the housing 10. The first and second terminals 20A and 20B are locked by unillustrated locking lances in the first and second cavities 11A and 11B to be retained in the housing 10.

The first and second terminals 20A and 20B have the same shape and same size.

Note that, although the structure of the first terminal 20A is described for the sake of convenience in the following description, the same holds true for the second terminals 20B.

Figure 3:
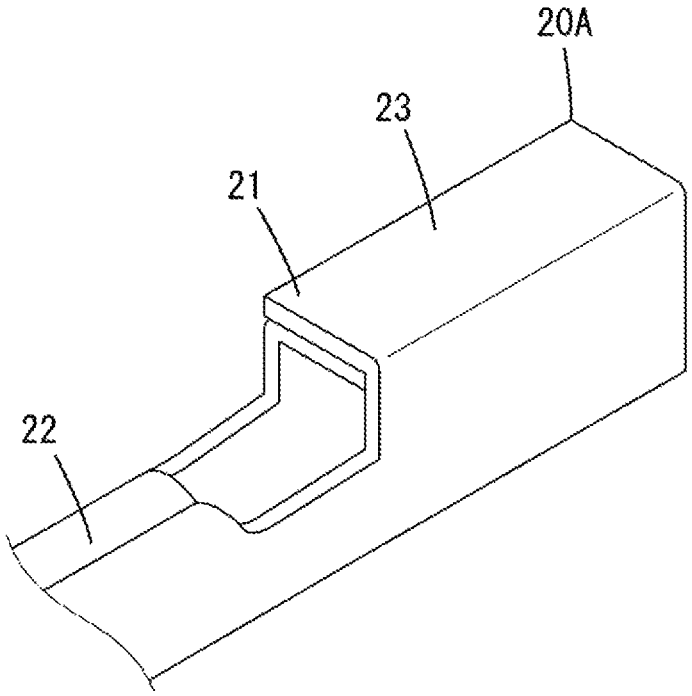
FIG. 3 is a partial perspective view of a first terminal.

The first terminal 20A is formed integrally, such as by bending a conductive metal plate, and includes a rectangular tubular body 21 and a barrel 22 in the form of an open barrel provided behind the body 21, as shown in FIG. 3. The barrel 22 is electrically and mechanically crimped and connected to an end part of an unillustrated wire.

The upper surface of an outer wall of a ceiling plate of the body 21 is flat in the front-rear direction and width direction and, as shown in FIG. 1, faces the first communication portion 13A of the housing 10 to define a contact surface 23 that contacts the later-described first contact piece 62A of the busbar 60.

As shown in FIG. 1, a deflectable and deformable resilient contact 24 projects rearward in the body 21 from the front end of a bottom plate opposite to the contact surface 23. If the housing 10 is fit to the unillustrated mating housing, a male tab of the mating first terminal enters the body 21 and the resilient contact 24 resiliently contacts the tab so that the first terminal 20A is connected electrically to the mating first terminal.

[Busbar 60]

Figure 2:
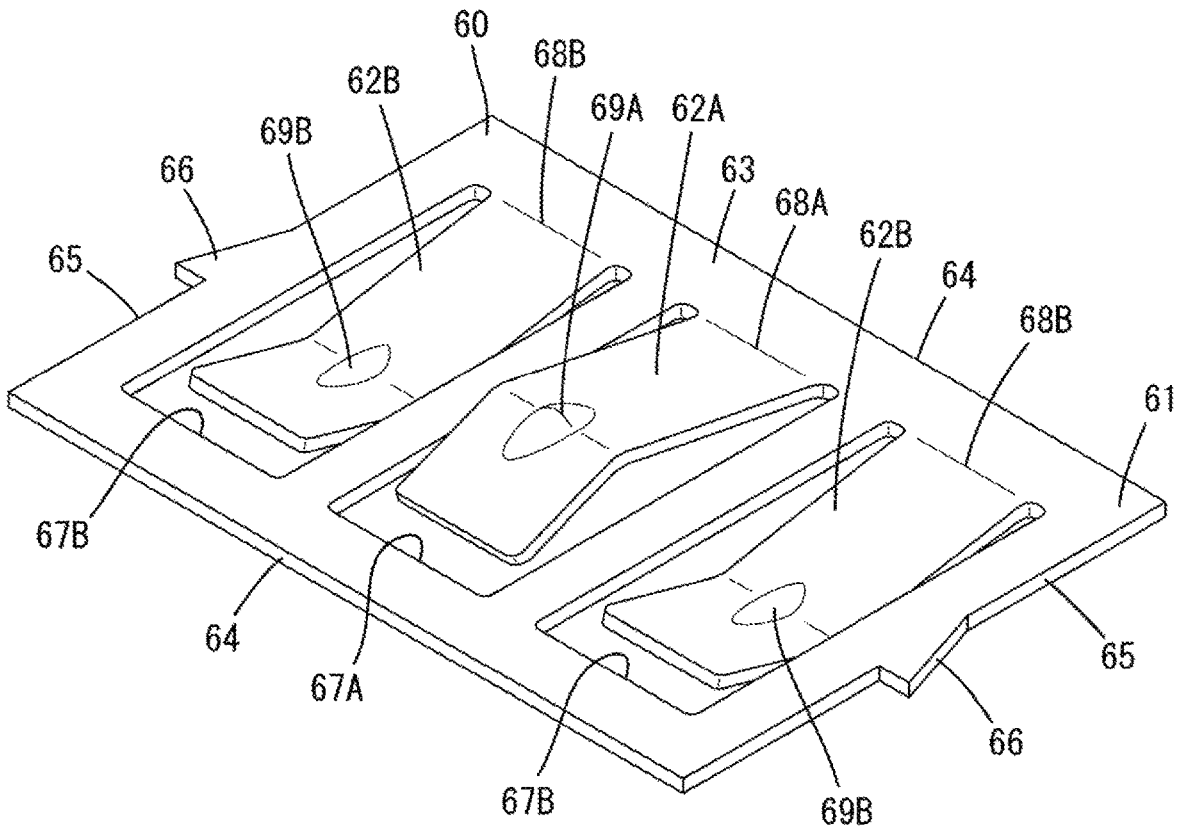
FIG. 2 is a perspective view of a busbar.

The busbar 60 is formed integrally from a conductive metal plate that is stamped into a predetermined shape and then cut and raised to include a busbar body 61 in the form of a flat plate, as shown in FIG. 2 An outer periphery of the busbar body 61 is provided with a frame 63 that is rectangular in a plan view. An outer edge of the frame 63 is composed of two long sides 64 along the width direction and two short sides 65 along the front-rear direction. Locking projections 66 protrude laterally from the short sides 65 of the frame 63. Each locking projection 66 is in the form of a claw and is continuous with the frame 63 without any step in a plate-thickness direction. The busbar 60 is inserted into the mounting groove 12 of the housing 10 from the front and the respective locking projections 66 bite into both widthwise end surfaces of the mounting groove 12 for locking (see FIG. 1) to retain the busbar 60 in the housing 10.

The busbar body 61 includes one first contact piece 62A and two second contact pieces 62B provided side by side in the width direction inside the frame 63. The first contact piece 62A is in a widthwise central part of the busbar body 61, and the second contact pieces 62B are at both widthwise sides of the busbar body 61. Cutouts 67A, 67B that are U-shaped in a plan view are formed in the busbar body 61 around the first contact piece 62A and the second contact pieces 62B. Each of the first and second contact pieces 62A and 62B is bent into a chevron shape in a side view by bending a strip-like part inside the cutout 67A, 67B with a front base end part 68A, 68B connected to the frame 63 as a starting point.

The first contact piece 62A is formed by bending the strip-like part to project toward an upper side (first stage side) in the height direction where the first cavity 11A is arranged, which is one side in the plate thickness direction of the busbar body 61. Each of the second contact pieces 62B is formed by bending the strip-like part to project toward the lower side (second stage side) in the height direction where the respective second cavities 11B are arranged, which is the other side in the plate thickness direction of the busbar body 61. That is, the first contact piece 62A and the respective second contact pieces 62B are arranged alternately in the width direction while projecting in different directions. Each of the first and second contact pieces 62A and 62B has an embossed contact portion 69A, 69B on a tip of the chevron shape in the side view.

Next, functions and effects of this embodiment are described.

In assembling, the busbar body 61 is press-fit and accommodated into the mounting groove 12 of the housing 10 from the front (see FIG. 1). The front ends of the long side parts 64 of the busbar body 61 are stopped in contact with the rear end of the mounting groove 12 and the locking projections 66 are locked to the both widthwise end surfaces of the mounting groove 12 to position and mount the busbar 60 in the housing 20. With the busbar body 61 accommodated in the mounting groove 12, the first contact piece 62A enters the first communication portion 13A, the contact portion 69A is arranged in the first cavity 11A, the second contact pieces 62B enter the respective second communication portions 13B and the contact portions 69B are arranged in the respective second cavities 11B.

Subsequently, the first terminal 20A is inserted into the first cavity 11A from behind, and the second terminals 20B are inserted into the respective second cavities 11B from behind. In the process of inserting the first terminal 20A into the first cavity 11A, the contact surface 23 of the body 21 of the first terminal 20A slides in contact with the contact portion 69A of the first contact piece 62A so that external matter, such as dust and dirt attached to the contact portion 69A, are removed (wiped). Similarly, external matter attached to the contact portions 69B of the respective second contact pieces 62B are removed in the inserting process of the second terminals 20B into the respective second cavities 11B.

With the busbar body 61 accommodated in the mounting groove 12, there is a concern that the first and second contact pieces 62A and 62B may interfere with external matter to be deflected and deformed. However, in this embodiment, the first contact piece 62A and the second contact pieces 62B contact the corresponding restricting surfaces 14A, 14B before being deflected and deformed beyond a resilience limit and are not excessively deflected or deformed. Thus, settling deformation (plastic deformation) of the first contact piece 62A and the second contact pieces 62B is prevented.

If the first terminal 20A is inserted properly into the first cavity 11A, the contact portion 69A of the first contact piece 62A contacts the contact surface 23 of the body 21 of the first terminal 20A in a state where the first contact piece 62A is deflected and deformed with the base end 68A as a fulcrum. Similarly, if each second terminal 20B is inserted properly into the corresponding second cavity 11B, the contact portion 69B of the second contact piece 62B contacts the contact surface 23 of the body 21 of the second terminal 20B in a state where the second contact piece 62B is deflected and deformed with the base end 68B as a fulcrum. In this case, a good contact state between the contact portions 69A, 69B and the first and second terminals 20A and 20B can be obtained by the wiping action.

Thereafter, the housing 10 is fit to the mating housing, the male tab of the mating first terminal is inserted and connected to the body 21 of the first terminal 20A and the male tab of each mating second terminal is inserted and connected to the body 21 of each second terminal 20B. In this way, the first terminal 20A, the respective second terminals 20B, the mating first terminal and the respective mating second terminals are joined via the busbar 60 and a joint circuit is formed by wires connected to the respective terminals.

Note that, contrary to the above assembling procedure, it is also possible to adopt a procedure of inserting the busbar 61 into the mounting groove 12 after the first terminal 20A is inserted into the first cavity 11A and the respective second terminals 20B are inserted into the respective second cavities 11B.

As described above, according to this embodiment, one first cavity 11A is provided in the upper stage side of the housing 10 and two second cavities 11B are provided in the lower stage side of the housing 10. The first cavity 11A and the second cavities 11B are arranged alternately in the width direction while being shifted. The first terminal 20A and the second terminals 20B are accommodated into the first cavity 11A and the respective second cavities 11B. Additionally, the first contact piece 62A and the respective second contact pieces 62B of the busbar 60 contact the first terminal 20A and the respective second terminals 20B. Thus, the first contact piece 62A and the respective second contact pieces 62B are arranged alternately in the width direction while respectively projecting up and down in the busbar body 61. Therefore, the busbar 60 can have a single-plate structure, so that a material yield can be improved and manufacturing cost can be reduced.

Excessive deflection is restricted by the contact of the first contact piece 62A and the respective second contact pieces 62B with the restricting surfaces 14A, 14B of the mounting groove 12. In this case, the restricting surfaces 14A, 14B are provided on the upper and lower surfaces of the mounting groove 12 without having any special shape. Thus, the entire structure need not be complicated.

The busbar body 61 is provided with the frame 63 extending over the entire periphery outside the first contact piece 62A and the respective second contact pieces 62B, as shown in FIG. 2. Thus, the strength of the busbar body 61 is ensured.

Furthermore, general female terminal fittings can be used as the first terminal 20A and the respective second terminals 20B, so that versatility is excellent. Further, the first terminal 20A and the second terminals 20B can be connected respectively to the mating first terminal and the mating second terminals via the bodies 21 and a width of the joint circuit can be expanded.

Other embodiments are briefly described below.

Two or more first cavities, two or more first terminals and two or more first contact pieces may be provided.

Three or more second cavities, three or more second terminals and three or more second contact pieces may be provided.

The first and second terminals may be configured to have mutually different shapes and sizes. In this case, the first and second cavities may also be configured to have mutually different cross-sectional shapes and opening diameters.

Contrary to the above embodiment, the first cavity, the first terminal and the first contact piece may be arranged on the lower stage side of the housing and the second cavities, the second terminals and the second contact pieces may be arranged on the upper stage side of the housing.

The housing may include a plurality of pairs of cavity parts corresponding to the first and second cavities.

The first terminal and the second terminals may be male terminal fittings each including a male tab projecting forward from a tubular body.

The cutouts formed around each of the first contact piece and the second contact pieces in the busbar body may be open in one end, e.g. a rear end, of the busbar body.

The base end parts of the respective first and second contact pieces may be provided on sides opposite to each other in the front-rear direction.

LIST OF REFERENCE SIGNS

10 . . . housing
11A . . . first cavity
11B . . . second cavity
12 . . . mounting groove
13A . . . first communication portion
13B . . . second communication portion
14A, 14B . . . restricting surface
20A . . . first terminal
20B . . . second terminal
21 . . . body
60 . . . busbar
61 . . . busbar body
62A . . . first contact piece
62B . . . second contact piece

What is claimed is:

1. A joint connector, comprising:

a housing including at least one first cavity provided in a first stage, second cavities provided in a second stage and a mounting groove provided between the first cavity and the second cavities in a row direction;

at least one first terminal to be accommodated into the first cavity;

second terminals to be accommodated into the second cavities; and a busbar made of metal and having a busbar body in the form of a single plate to be mounted into the mounting groove, wherein:

the first cavity and the second cavities are arranged alternately in a column direction while being shifted in the housing, and the busbar includes at least one first contact piece projecting from the busbar body toward the first stage side and configured to contact the first terminal and second contact pieces projecting from the busbar body toward the second stage and configured to contact the second terminals.

2. The joint connector of claim 1, wherein the housing includes a first communication portion allowing communication between the mounting groove and the first cavity in the row direction and second communication portions allowing communication between the mounting groove and the second cavities in the row direction, and surfaces of the mounting groove facing the first and second communication portions serve as restricting surfaces configured to restrict excessive deflection of the first and second contact pieces.

3. The joint connector of claim 2, wherein the first contact piece is cut and raised toward the first stage and the second contact pieces are cut and raised toward the second stage in the busbar body and a frame extending over an entire periphery is provided outside the first and second contact pieces.

4. The joint connector of claim 3, wherein each of the first and second terminals includes a tubular body, and the first and second contact pieces contact outer surfaces of the bodies.

5. The joint connector of claim 1, wherein the first contact piece is cut and raised toward the first stage and the second contact pieces are cut and raised toward the second stage in the busbar body and a frame extending over an entire periphery is provided outside the first and second contact pieces.

6. The joint connector of claim 1, wherein each of the first and second terminals includes a tubular body, and the first and second contact pieces contact outer surfaces of the bodies.

* * * * *